United States Patent [19]

Haney

[11] 4,373,835

[45] Feb. 15, 1983

[54] REMOVABLE CLOSURE PLATE

[75] Inventor: James A. Haney, New Orleans, La.

[73] Assignee: McDermott Incorporated, New Orleans, La.

[21] Appl. No.: 161,988

[22] Filed: Jun. 23, 1980

[51] Int. Cl.[3] ..... F02B 17/04

[52] U.S. Cl. ..... 405/195; 220/234; 405/227

[58] Field of Search ..... 405/195, 205, 206, 224, 405/225, 227; 138/89, 109; 220/233, 234, 235, 265

[56] References Cited

U.S. PATENT DOCUMENTS

| | | | |
|---|---|---|---|
| 3,577,737 | 5/1971 | Burleson | 405/227 |
| 3,613,381 | 10/1971 | Cox | 405/206 |
| 4,142,371 | 3/1979 | Mayfield et al. | 405/224 |
| 4,160,612 | 7/1979 | Britton et al. | 405/227 |
| 4,212,563 | 7/1980 | Weidler et al. | 405/195 |

*Primary Examiner*—David H. Corbin

*Attorney, Agent, or Firm*—Robert J. Edwards; John L. LaPierre

[57] ABSTRACT

An improved removable closure plate arrangement providing a liquid-tight seal in an elongated floatable offshore hollow tubular column structure. The closure plate being adapted for easy removal and including a centrally located pull member removably connected to the upper and fixedly connected to the lower portion of the closure plate with the closure plate being removably connected about its periphery to the inside surface of the column.

10 Claims, 12 Drawing Figures

REMOVABLE CLOSURE PLATE

BACKGROUND OF THE INVENTION

This invention relates to an improved removable closure plate construction that is adapted for easy removal and provides a liquid-tight seal in an elongated floatable offshore hollow tubular column structure.

Closure plates are typically utilized in conjunction with offshore platforms having a subsurface structure referred to as a jacket. The jacket structure contains a plurality of tubular columns through which piles are driven during installation. Jackets which are too large to be lifted must be launched after transportation to an offshore installation site. Jackets are usually constructed on shore with temporary closure plates installed in the jacket legs or columns to render the structure buoyant. The closure plates are selectively located within the jacket columns so that the jacket floats in a predictable, stable position. To achieve a predictable, stable, flotation position, the closure plates must be placed in the columns to form flotation chambers which can be selectively flooded with water at the installation site to rotate the jacket to the proper upright position. When the jacket is in its proper upright position, the column closure plates are removed to provide substantially unobstructed access through which piles are driven to anchor the jacket to the ocean bed.

The object of the present invention is to provide an improved removable closure plate of the type disclosed in U.S. Pat. No. 3,613,381. In the prior art, the lower closure plate assembly is basically a truncated plate cone whose circumference is welded to the inside wall of a jacket column and when used in conjunction with an upper closure plate forms a flotation chamber. A chain is welded to the underside of the cone about its perimeter and the chain is attached to an eccentrically located pulling arm which extends through the cone. The closure plate is torn away from the column in segments by the application of a force to the pulling arm.

The present invention eliminates the eccentrically located pull arm and the chain welded to the underside of the closure plate as disclosed in the prior art. The improved removable closure plate, herein disclosed, centrally locates the pulling arm, is capable of resisting pressure from both sides and can be constructed of relatively thin metal for use in large diameter columns. Additionally, the improved removable closure plate is capable of resisting greater pressures for a comparable material thickness, is broken away from the column as a unit and develops a very large mechanical advantage for ease in removal.

SUMMARY OF THE INVENTION

The present invention relates to improvement in the construction of a removable closure plate of the type used in an elongated hollow tubular column structure which is adapted for flotation to an offshore site where it is immersed by flooding for installation in an upright position. The closure plate, adapted for easy removal, provides a liquid-tight seal in the columnar structure. The improved closure plate centrally locates a tearing pull arm device that is removably connected to the upper central portion of the closure plate and further rigidly secures the pull arm to the hub section of the lower component portion of the closure plate. The closure plate is further removably connected, about its periphery, to the inside surface of the column. The lower component part of the closure plate is fixedly connected, circumferentially, to the upper portion of the closure plate. The closure plate connections both about the pull arm and about the column form liquid-tight seals.

The closure plate is removed by exerting a force through a wire rope, cable, or the like which is connected to the pull arm. As the force exerted through the connection and transmitted to the pull arm is sufficiently increased, the seal about the upper portion of the closure plate and pull arm is ruptured. The applied force is maintained until it is sufficient to then rupture the seal between the closure plate and the column. The closure plate is thus broken away from and pulled upthrough and out of the column as a unit.

The invention will be described in relation to a single closure plate used to provide a liquid-tight seal in a hollow column. However, it should be understood that the invention applies equally to a plurality of closure plates used to form liquid-tight compartments in a single hollow tubular structure.

The various features of novelty which characterize the invention are pointed out with particularity in the claims annexed to and forming a part of this disclosure. For a better understanding of the invention, its operating advantages and specific results obtained by its use, reference should be made to the accompanying drawings and descriptive matter in which there is illustrated and described a typical embodiment of the invention.

DETAILED DESCRIPTION OF THE PREFERRED EMBODIMENT

Figure 6:
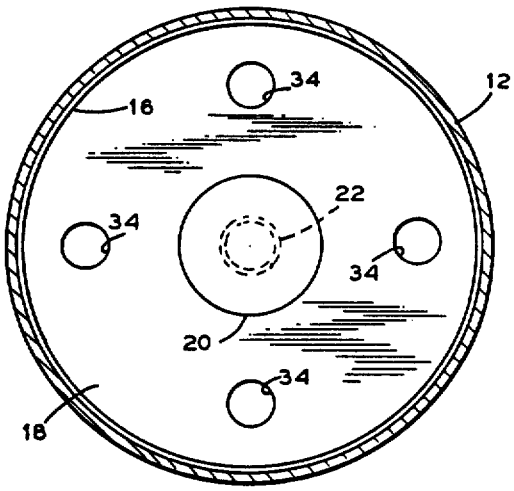
FIG. 6 is a bottom plan view of the closure plate taken along line 6—6 of FIG. 1.

Referring to FIGS. 1-6, there is illustrated a portion of a jacket column 10 of an offshore platform, not shown, depicting an installed improved removable closure plate 14. The closure plate 14 has a substantially hemispherical upper component portion 16, a lower component portion 18 and a centrally located tearing pull arm or pull member 22. Pull arm 22 extends through a central opening in upper portion 16 and is removably connected about its circumference to upper portion 16 by seal weld 24 and is further rigidly connected circumferentially about its base to hub 20 of lower portion 18 by weld 28. Closure plate 14 is removably connected about its periphery to the inside surface of column 10 by means of seal weld 26. The closure plate with welds about pull arm 22 and column wall 12 is designed to resist hydrostatic pressure from either side, as required. Lower portion 18 is fixedly connected about its circumference to upper portion 16 and fixedly connected radially about hub 20 by means of welds 32, depicted in FIGS. 4, and 30 respectively. Aperture 23 is located in pull arm 22 to receive a wire rope, cable, chain, or the like, not shown, that will be utilized to exert an external tearing or breakaway force on pull arm 22 to remove closure plate 14 from the inside surface of wall 12 of column 10. The seal welds between pull arm 22 and upper closure plate portion 16 and between the closure plate and the inside surface of column wall 12 are liquid tight. Lower portion 18 has a disc shaped configuration having a plurality of openings 34 as illustrated in FIG. 6.

It should be noted that, for discussion purposes, the welds herein described are referred to as welds or seal welds whereas the concept disclosed applies equally to other types of connections wherein surfaces between metal parts are sealed.

Figure 7:
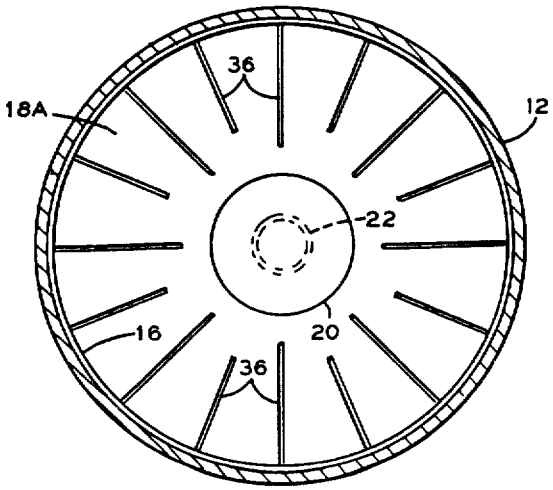
FIG. 7 and FIG. 8 illustrate alternate embodiments of the structure depicted in FIG. 6.
Figure 8:
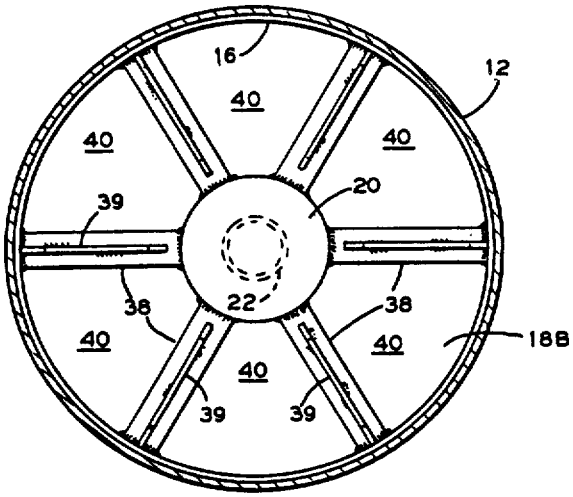

FIGS. 7–8 depict different embodiments of the bottom plan view of the lower portion 18A, 18B of closure plate 14. Lower portion 18A, 18B has a plurality of apertures such as the elongated slots 36 of FIG. 7 or the spaces 40 between radial spokes 38 of FIG. 8. Radial spokes 38 are strengthened by reinforcing ribs 39.

The openings in lower portion 18, 18A, 18B allow water to enter the space between the upper and lower closure plate portions 16 and 18 and allows the passage of water therethrough to prevent the application of net hydrostatic force to lower portion 18, 18A, 18B.

Figure 9:
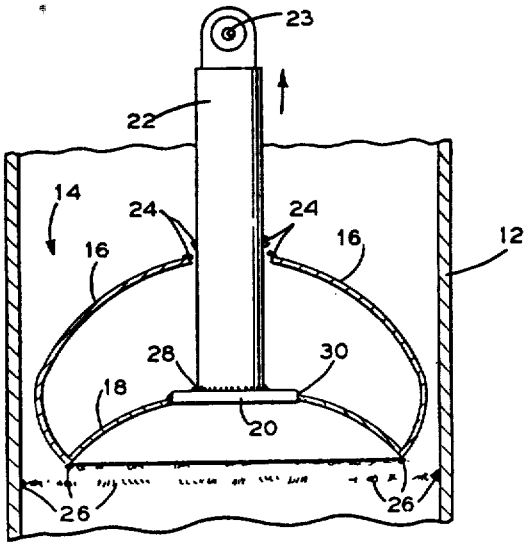
FIG. 9 is a sectional elevation view depicting the closure plate after it has broken away from the column.

Closure plate 14 is disengaged from the inside surface of column wall 12 by exerting a force on pull arm 22 through a connection, not shown, affixed to pull arm 22 at its aperture 23. Sufficient force is applied to pull arm 22 to first rupture seal weld 24 between upper portion 16 and pull arm 22. The force is sufficiently maintained to then pull hub 20 out of the plane of lower portion or disc 18 with the resulting development of very high radial tension in disc 18 that ruptures seal weld 26 between the closure plate and the inside surface of column wall 12. Closure plate 14 is thus broken away from and pulled up through and out of column 10 as a unit as depicted in FIG. 9.

Figure 10:
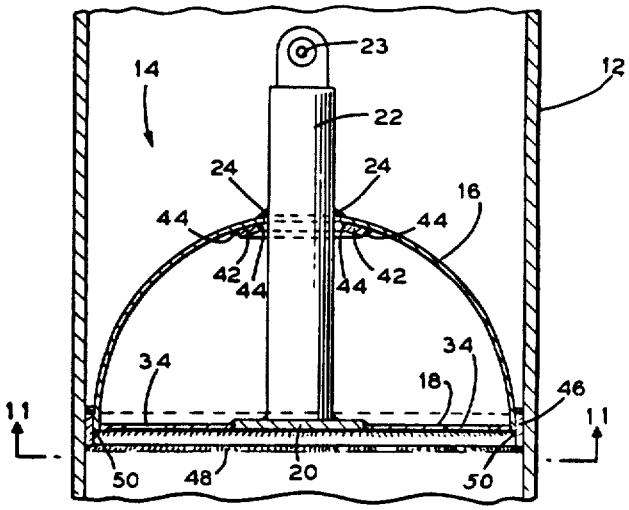
FIG. 10 illustrates an alternate embodiment of the closure plate depicted in FIG. 1.
Figure 11:
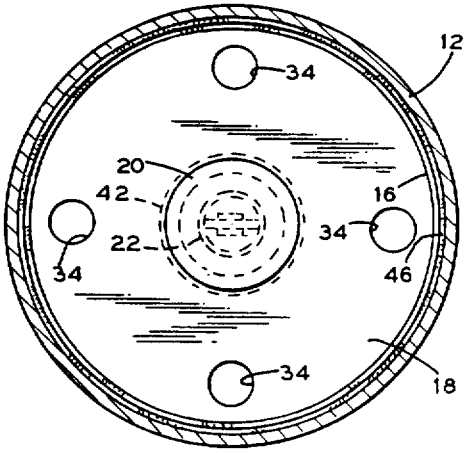
FIG. 11 is a bottom plan view of the closure plate taken along line 11—11 of FIG. 10.

FIGS. 10–11 depict an alternate embodiment of closure plate 14 wherein a circumferential metal reinforcing ring 42 is disposed adjacent to pull arm 22 and is fixedly connected about its periphery to upper closure plate portion 16 by the placement of welds 44. Additionally, a continuous metal shim 46 is rigidly connected to the inside surface of wall 12 of column 10 through connecting seal welds 48 placed along the upper and lower surfaces of shim 46. The closure plate is removably connected about its periphery in a liquid-tight manner to shim 46 by seal weld 50.

Figure 1:
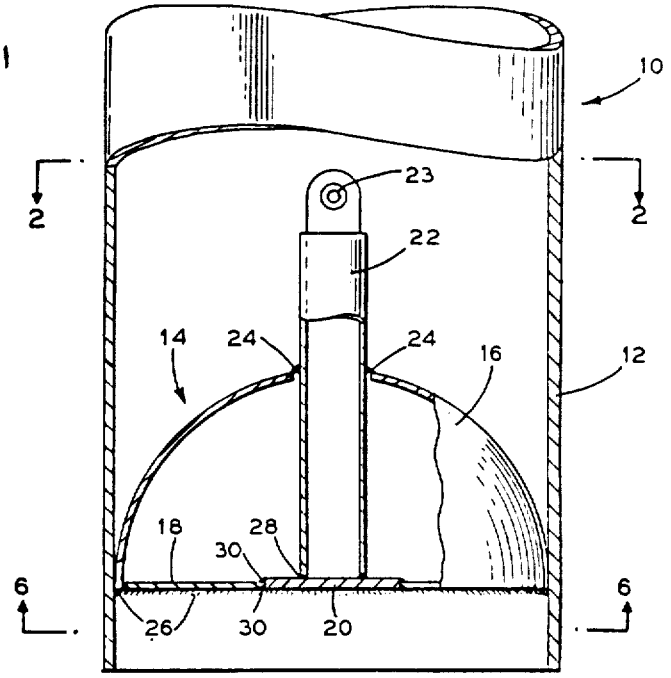
FIG. 1 is a partial sectional side elevation view of a hollow tubular column structure depicting an improved removable closure plate.
Figure 2:
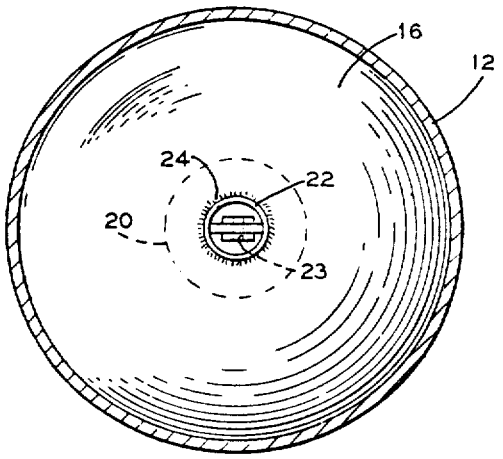
FIG. 2 is a plan view of the closure plate taken along line 2—2 of FIG. 1.
Figure 3:
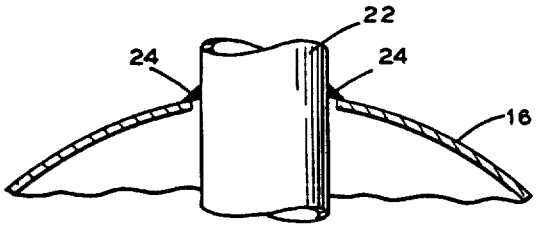
FIG. 3 is an enlarged detailed sectional elevation view depicting the upper central portion of the closure plate shown in FIG. 1.
Figure 4:
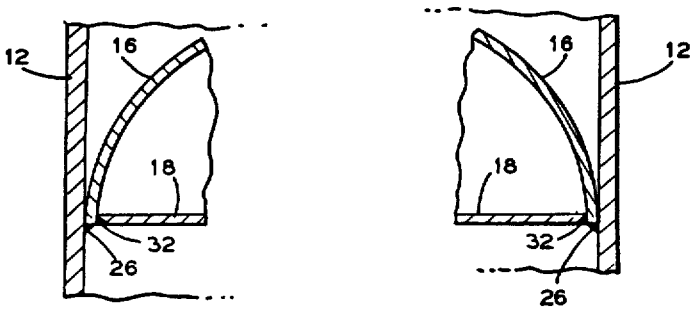
FIG. 4 is an enlarged fragmentary view depicting the lower portion of the closure plate connected to the column wall as shown in FIG. 1.
Figure 5:
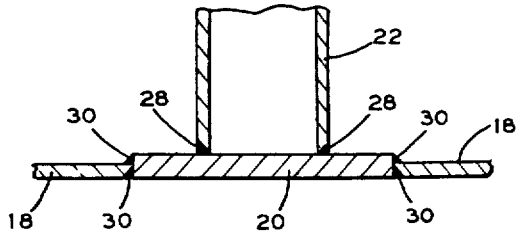
FIG. 5 is an enlarged detailed sectional elevation view depicting the lower central portion of the closure plate shown in FIG. 1.
Figure 12:
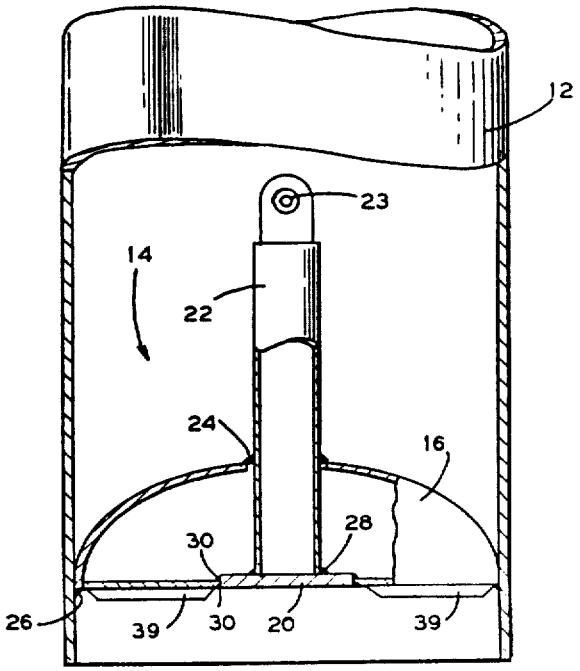
FIG. 12 illustrates another embodiment of the closure plate depicted in FIG. 1.

FIG. 12 illustrates another embodiment of the invention wherein the closure plate upper portion 16 is substantially of a torispherical configuration, all other depicted elements being alike to those described with respect to FIGS. 1 and 8. It will be understood that the torispherical upper portion 16 is usually applicable with the embodiments shown in FIGS. 6, 7 and 10.

It will be further understood that the closure plate upper portion configuration also encompasses such shapes as ellipsoidal, conical or other surface of revolution. All other elements being alike those herein described in the specification.

The embodiments of the invention in which an exclusive property or privilege is claimed are defined as follows:

1. An improved removable closure plate of the type used in an elongated hollow tubular column structure which is adapted to be floated to an offshore site where it is immersed by flooding for installation in an upright position wherein the closure plate includes upper and lower portions, a centrally located pull member, the pull member extending through an aperture located in said upper portion and further being removably connected to the upper portion in a liquid tight manner and rigidly connected to the lower portion, the lower portion having a plurality of apertures disposed therein, the closure plate having its circumferential periphery removably connected to the inside surface of the column to form a liquid tight seal, and means for disengaging the closure plate from the column by exerting a force on the pull member sufficient to first rupture the seal about the upper portion and by maintaining a force sufficient to then rupture the seal between the closure plate and the column.

2. A closure plate according to claim 1 wherein the upper portion is substantially hemispherical.

3. A closure plate according to claim 1 wherein the upper portion is substantially torispherical.

4. A closure plate according to claim 1 wherein the lower portion is substantially torispherical.

5. A closure plate according to claim 4 wherein said disc has a plurality of elongated slots.

6. A closure plate according to claim 4 wherein said disc has a plurality of reinforced radial spokes.

7. A closure plate according to claim 1 wherein the upper portion is reinforced by a circumferential metal ring.

8. A closure plate according to claim 7 wherein said metal ring is disposed adjacent the pull member.

9. A closure plate according to claim 1 including a continuous shim rigidly connected to the inside surface of the column.

10. A closure plate according to claim 9 wherein the closure plate is removably connected about its periphery to said shim.

* * * * *